US008305015B2

(12) United States Patent
Barea et al.

(10) Patent No.: US 8,305,015 B2
(45) Date of Patent: Nov. 6, 2012

(54) SYSTEM FOR CONTROLLING THE FEED OF A YARN OR WIRE TO A MACHINE, AND RELATIVE METHOD

(75) Inventors: Tiziano Barea, Busto Arsizio (IT); Massimo Tomazzolli, Busto Arsizio (IT)

(73) Assignee: B.T.S.R. International S.p.A., Olgiate Olona (IT)

( * ) Notice: Subject to any disclaimer, the term of this patent is extended or adjusted under 35 U.S.C. 154(b) by 657 days.

(21) Appl. No.: 12/352,738

(22) Filed: Jan. 13, 2009

(65) Prior Publication Data

US 2009/0183528 A1 Jul. 23, 2009

(30) Foreign Application Priority Data

Jan. 17, 2008 (IT) ..... MI2008A0062

(51) Int. Cl.
*B65H 59/38* (2006.01)
*B65H 77/00* (2006.01)

(52) U.S. Cl. ..... 318/6; 318/661

(58) Field of Classification Search ..... 318/6, 602, 318/605, 661
See application file for complete search history.

(56) References Cited

U.S. PATENT DOCUMENTS

| | | | | |
|---|---|---|---|---|
| 4,540,925 | A * | 9/1985 | Jones | 318/602 |
| 5,202,610 | A * | 4/1993 | Frye et al. | 318/6 |
| 6,418,274 | B2 * | 7/2002 | Tanaka | 388/800 |
| 7,659,688 | B2 * | 2/2010 | Schulz et al. | 318/807 |

FOREIGN PATENT DOCUMENTS

| | | |
|---|---|---|
| CN | 200810181706.1 | 12/2008 |
| CN | 200910002534.7 | 1/2009 |
| EP | 08169986.0 | 11/2008 |
| EP | 08172477.5 | 12/2008 |
| JP | 2008-309595 | 12/2008 |
| JP | 2009-7013 | 1/2009 |

OTHER PUBLICATIONS

U.S. Appl. No. 12/352,738, filed Dec. 13, 2009, Tiziano Barea.
U.S. Appl. No. 12/327,296, filed Dec. 3, 2008, Tiziano Barea.

* cited by examiner

*Primary Examiner* — Derek Rosenau
(74) *Attorney, Agent, or Firm* — Cozen O'Connor

(57) ABSTRACT

A system for controlling the feed of a yarn to a textile machine or a metal wire to a coil winder. The yarn or wire unwinds from its spool and cooperates with a rotary member associated with its own rotation actuator before being directed to the machine. The yarn or wire has a characteristic value of tension and/or speed and/or quantity during this feed, and the actuator has a stator and a rotor acting on an exit drive shaft, which has its own piloting arrangement. The rotary member about which the yarn or wire winds is keyed onto the exit drive shaft. This control system measures the angular position of the drive shaft and compares an instantaneous parameter of that angular position to a prefixed characteristic value of the yarn or wire Command signals are then fed to the actuator's piloting arrangement to conform the instantaneous parameter with this prefixed value.

18 Claims, 2 Drawing Sheets

SYSTEM FOR CONTROLLING THE FEED OF A YARN OR WIRE TO A MACHINE, AND RELATIVE METHOD

The present invention relates to a control system and relative method in accordance with the introduction to the corresponding main claims.

Yarns supplied to a textile machine for feeding a textile process or for forming fabrics and articles with or without seams are known to be fed to the textile machine by yarn feed devices which control the tension and/or speed and/or quantity of the fed yarn. Similar devices are known to control the tension and/or speed and/or quantity of a wire fed to a machine or coil winder wherein a metal wire, e.g. a copper wire, is wound on a support.

These yarn or wire feed devices comprise a body on which a wheel (or rotary member) is rotatably mounted, driven by an actuator, for example a stepping or brushless motor, positioned within the housing.

The yarn or metal wire to be supplied to the machine, and which unwinds from a corresponding spool, is wound one or more times about the wheel before being supplied to said machine. The speed with which the wheel is rotated by the actuator determines the speed or tension with which the yarn or wire is fed to the machine, and consequently the tension or speed of the yarn itself.

FIG. 1 shows a block diagram of a general known solution for regulating the feed tension and hence the speed of the actuator A which controls the wheel, to obtain the desired yarn or metal wire tension.

Downstream of the wheel a tension sensor CC, e.g. a load cell, is positioned to measure the yarn tension (or the tension of a wire, e.g. a copper wire) and to feed a tension signal SM correlated to this information to a PID (proportional-integral-derivative) tension controller, PID. This tension controller PID compares the signal SM with a tension reference signal (or set point), programmable relative to the desired yarn (or metal wire) feed tension. If a difference between the measured signal S1 and the reference signal SP is detected, command signals are fed to control means MC for the actuator A to vary the rotational speed of the actuator A such as to obtain the desired yarn or wire tension.

However the actuators of known type, in particular brushless motors, have a considerable accelerating action but poor braking action. In particular, the actuator braking action is greater the greater the rotational speed of the actuator rotor.

Hence at low motor speed, the resistance to rotation of this type of actuator is very low, hence a yarn (or metal wire) wound about the drive shaft which has not yet reached the desired tension can drag the actuator into rotation without allowing the yarn (or metal wire) to reach the required tension.

In the same manner, a traction upstream or downstream of the feed device for the yarn (or wire), which being wound about the wheel connected to the actuator A can undesirably drag the actuator drive shaft into rotation, means that it is no longer able to ensure correct yarn feed tension.

This drawback is due to the fact that at low speeds, currently used actuators have a low braking torque which does not enable the yarn (or metal wire) feed tension to be finely controlled.

Although this drawback is particularly evident for brushless motors, it is also present in stepping motors (particularly at high speeds).

With reference to the textile field, from Italian patent application MI2001A002063 filed on 5 Oct. 2001, a device is known for regulating and controlling textile yarn delivery which operates such as to vary the rotational speed of a brushless motor, to maintain it as far as possible synchronized with the speed of the textile machine served.

Although advantageous from various aspects, this solution does not solve the problem of undesirable dragging of the feed device drive shaft at low speeds and high tensions, as this device is controlled only on the basis of the rotation of the textile machine served, without controlling tension.

This solution also requires an interface or synchronism with the machine and cannot be installed or used in any machine in which this interface is not provided.

An object of the present invention is therefore to provide a system and method for achieving optimal control of the yarn or metal wire fed to a textile machine or to a coil winder or similar machine at any rotational speed of the actuator acting on the rotary member about which the yarn (or wire) winds before being fed to the machine.

Another object of the present invention is to minimize the torque ripple feeding the motor as the rotor rotational speed varies.

A further object of the present invention is to provide a system able to operate both independently of and interfaced with the above machine.

These and other objects are attained by a system and method, the inventive characteristics of which are defined by the accompanying claims.

The invention will be more apparent from the ensuing detailed description of one embodiment thereof, provided by way of non-limiting example and illustrated in the accompanying drawings, in which.

Figure 1:
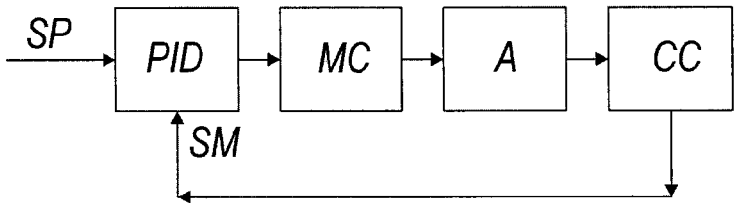
FIG. 1 shows a block diagram of a known control system.
Figure 2:
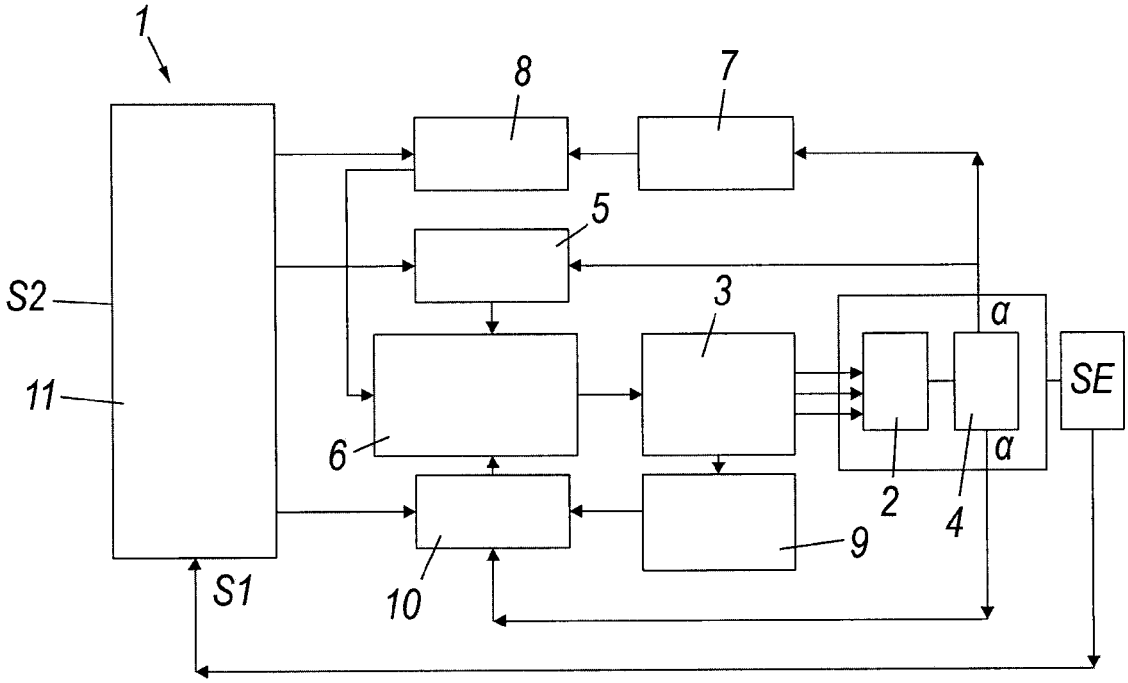
FIG. 2 shows a block diagram of a control system of the invention.

With reference to FIG. 2, this shows a system 1 (implemented in the textile field) for controlling the feed of a yarn to a textile machine, in which the yarn unwinds from its own spool and cooperates with a rotary member associated with its own rotation actuator 2 before being directed to the textile machine. The yarn has its own characteristic value of tension and/or speed and/or quantity during this feed. In known manner, the rotation actuator 2 comprises a stator and a rotor acting on an exit drive shaft 13 which is piloted by its own piloting means 3, 6. The rotary member about which the yarn winds is keyed onto the exit drive shaft 13. According to the invention, the control system comprises:

- means 4 for continuously measuring an angular position of the drive shaft of the actuator 2, for example by means of an encoder,
- comparison and command means 5, 8 connected downstream of the measurement means 4, to compare an instantaneous parameter correlated to the measured angular position of the drive shaft with a corresponding predetermined parameter relative to a predetermined characteristic value of the yarn, and to feed command signals to the piloting means 3, 6 for the actuator 2 such that said instantaneous parameter conforms to the predetermined parameter, such as to obtain the desired characteristic value of the yarn fed to the textile machine.

In particular, these parameters are the angular position or the speed of the drive shaft. By measuring the angular position with time, the rotational speed of the drive shaft can be calculated.

Advantageously according to the invention, the comparison and command means 5, 8, in the form for example of a PID controller, by knowing the angular position of the drive shaft are able to maintain the angular position or the drive shaft speed at the predetermined value (set point) so as to obtain the required characteristic value of the yarn fed to the textile machine independently of external stresses acting on the yarn.

Moreover advantageously according to the invention, even at low motor rotational speeds, the position or speed corresponding to the required characteristic value of the yarn fed to the textile machine is maintained.

Advantageously, the piloting means 3, 6 comprise an inverter 3 with its own piloting means 6, for example of vectorial type.

In particular, according to the invention, either the angular position or the speed of the drive shaft, or both, can be controlled.

In one embodiment of the invention, a first parameter controlled by the comparison and command means 5 is the angular position. Further comparison and command means 8 are used to control the speed of the drive shaft 13.

In this embodiment, the control system 1 of the invention also comprises:

means 7 for calculating an instantaneous speed of the drive shaft 13 of the actuator 2 starting from the angular position measured by the measurement means 4, comparison and command means 8 connected downstream of the speed calculation means 7, which compare the measured speed with a predetermined speed relative to a prefixed characteristic value of the yarn and feed command signals to piloting means 3, 6 for the actuator 2 such that the instantaneous speed of the drive shaft of the actuator 2 conforms to the predetermined speed in order to achieve the required characteristic value for the yarn fed to the textile machine.

In a further embodiment of the invention, means 9 for measuring currents passing through the inverter 3 are connected to the motor piloting means 3, 6, in particular to the inverter 3.

Comparison and command means 10 are connected downstream of the current measurement means 9 to compare instantaneous drive torque values correlated to the measured currents and to the measured angular position, with a predetermined torque relative to a prefixed value of the yarn, and to feed command signals to the piloting means 3, 6 for the actuator 2 so that the instantaneous torque of the drive shaft of the actuator 2 corresponds to the predetermined torque, in order to achieve the required characteristic value for the yarn fed to the textile machine.

In this manner, rotation of the actuator 2 is optimized also for maximum drive torque.

In particular, the predetermined actuator position, speed or torque parameters relative to a prefixed characteristic value of the yarn, i.e. its set points, are obtained from main comparison and command means 11.

For example, these main comparison and command means 11 are implemented by a PID controller.

In particular, this main PID controller 11 receives a signal S1 representing the measurement of the yarn characteristic value and compares it with reference signals for the yarn characteristic value to establish the predetermined position, speed and torque parameters (set points) to be fed to the PID controllers 5, 8 and 10.

In one embodiment of the invention, the signal S1 representing the measurement of the yarn characteristic value originates from a sensor SE positioned downstream of the rotary member which cooperates with the actuator 2 and about which the yarn winds to be fed to the textile machine. This sensor SE, which measures the yarn characteristic value, is for example a load cell as in the known art.

In one embodiment of the invention, the main PID controller 11 establishes whether to give priority to the speed set point or to the position set point or to cause the two parameters (position and speed) to interact to obtain the desired yarn value.

Advantageously, the comparison and command means are PID controllers.

In a preferred embodiment, the encoder 4 measures the absolute angular position of the drive shaft 13.

In this manner, during the starting stage of the system of the invention, it is also possible to measure the absolute angular position of the drive shaft 13, ensuring that the drive shaft 13 is maintained or positioned in the desired position (in this respect, with a classical incremental encoder it would be necessary, on starting, to activate a zeroing procedure before knowing the absolute position of the rotor).

Figure 3:
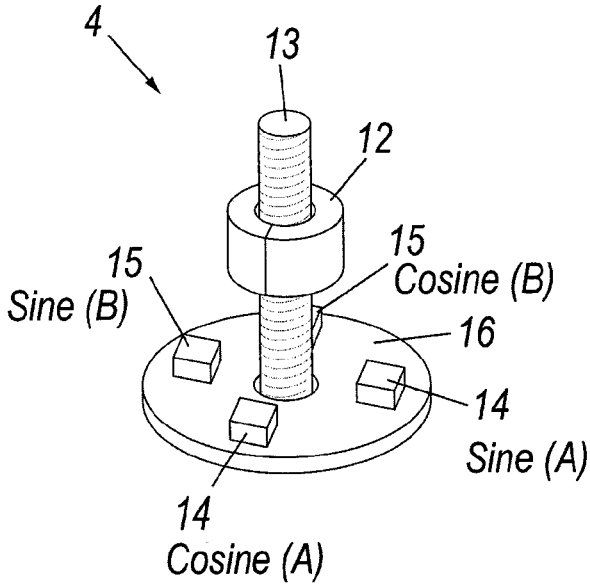
FIG. 3 shows an encoder to be used in the control system of the invention.

An example of an encoder 4 of this type is shown in FIG. 3, and comprises a polarized magnetic ring 12 in two or more suitably magnetized parts.

For simplicity, in the ensuing description, the magnetic ring 12 has only two portions of different polarity. This ring 12 is keyed onto a shaft 13 of the actuator 2, so that for each shaft rotation, there is a corresponding complete rotation of the magnetic ring 12 leading to the formation of a magnetic flux variable in space.

The shaft 13 can be a hollow shaft to allow passage of cables or of other drive shafts or of the yarn itself (for example to form a storage feeder device).

The variation in magnetic flux caused by the rotation of the magnetic ring 12 connected to the drive shaft 13 can be measured, for example, by at least one pair of Hall sensors positioned on a support 16, for example a disc, which is fixed relative to the drive shaft 13. These Hall sensors, which are of analogue type, are disposed about the drive shaft 13 and are advantageously fixed to the support 16. In the described example reference is made to two pairs of Hall sensors 14, 15, which are offset by 90 degrees.

In particular, the four sensors are distributed uniformly along the edge of the support 16, and in particular are positioned to form a cross.

During the rotation of the magnetic ring 12, each Hall sensor 14, 15 emits a respective electrical signal of sinusoidal pattern and is proportional to the magnetic field generated by the rotation of the magnetic ring 12, each signal being for example indicated by sine (A), cosine (A), sine (B) and cosine (B).

Figure 4:
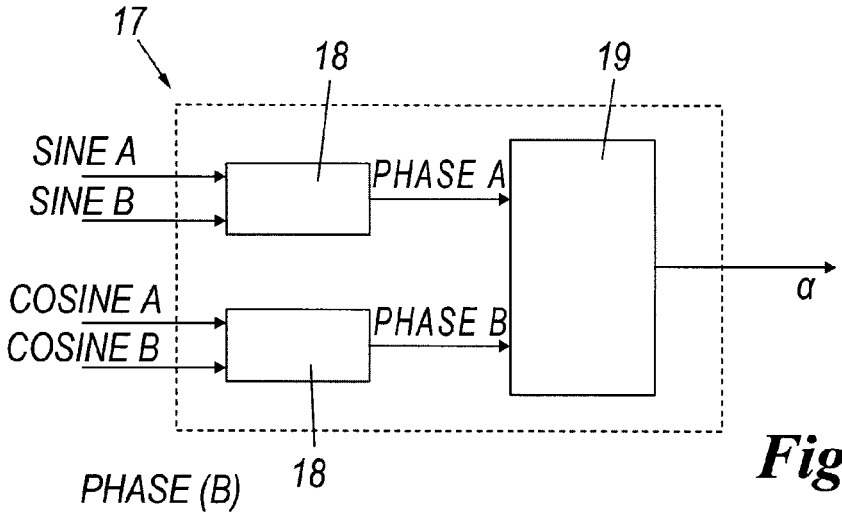
FIG. 4 shows a block diagram of a circuit for processing signals originating from the encoder of FIG. 3.

As shown in FIG. 4, a processing circuit 17 processes the signals sine (A), cosine (A), sine (B) and cosine (B) originating from the Hall sensors 14, 15, to obtain the absolute position of the drive shaft 13.

In particular, the pairs of signals obtained from the Hall sensors 14, 15 are compared by two respective differential stages 18: the signals sine (A) and sine (B), originating from sensors 14, 15 positioned symmetrically about the drive shaft 13, are connected for example to a first differential amplifier, the remaining signals cosine (A) and cosine (B) being connected for example to a second differential amplifier.

Figure 5:
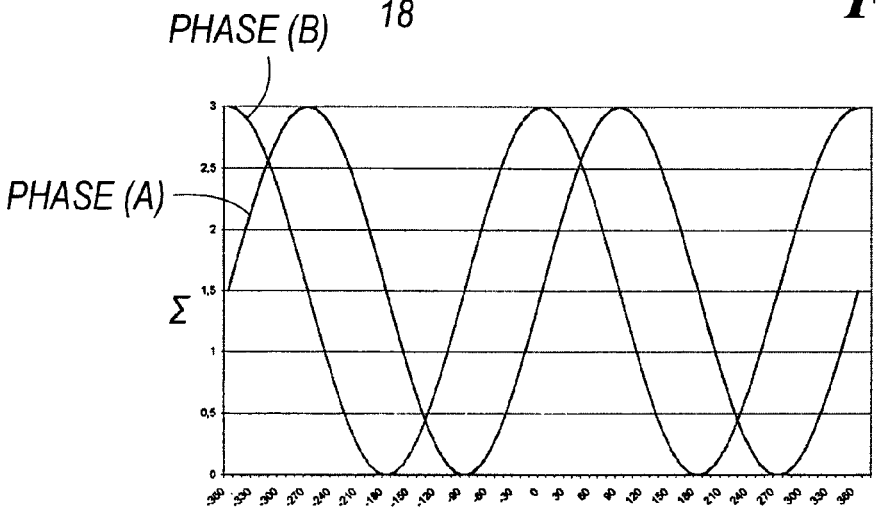
FIG. 5 shows some signals processed by the processing circuit of FIG. 4.

The output signals of the two differential stages 18, indicated as phase(A)/phase(B), are for example shown in FIG. 5 as a function of the absolute position of the drive shaft.

As these signals are offset by 90°, the angular position $\alpha$ of the magnetic ring 12 and hence of the drive shaft 13 can be obtained unequivocally from the relationship:

$$\alpha=\tan^{-1}(\text{phase}(A)/\text{phase}(B)).$$

This relationship can be implemented in known manner by a calculation device 19, for example a DSP (digital signal processor) or a microcontroller provided or interfaced with an analogue/digital converter.

The use of DSPs or microcontrollers also enables filtration operations to be implemented on the measured value of the angle $\alpha$ to minimize any errors with which the signals originating from the encoder 4 are affected due for example to mechanical tolerances with which the sensors are mounted, or because of noise present in the entire system.

For example, the angle $\alpha$ measured by the encoder 4 is made to pass through an estimating filter FS of known type to obtain the estimated value $\hat{\alpha}$ which has an error minimized compared with the aforesaid errors.

Figure 6:
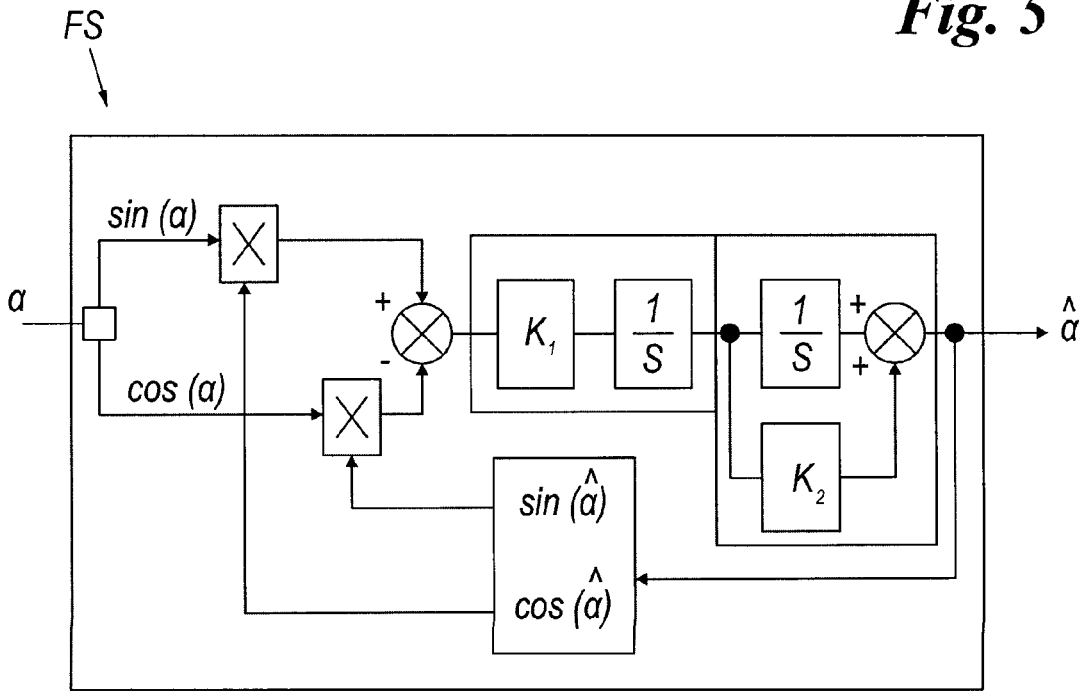
FIG. 6 shows a block diagram for implementing an estimating filter.

A possible block diagram of such an estimating filter FS with accompanying transfer function is shown in FIG. 6, in which K1 and K2 are constants and the blocks indicated by 1/s are integrator blocks.

There is nothing to prevent the estimating block FS shown in FIG. 6 from being made as an ad hoc circuit instead of being integrated into a single DSP which processes the signals originating from the Hall sensors.

When the estimating block FS is used, which is generally placed downstream of the encoder 4, it is the estimated value $\hat{\alpha}$ which is used as the angular position measured by the system of the invention.

Using the described encoder 4 has the advantage of operating on analogue quantities, so considerably improving the precision and accuracy of the signals obtained and hence the accuracy and precision of motor control. In this respect, the signals obtained originate from linear Hall sensors which have an analogue type resolution, hence very high. The only limitation comes from the resolution of the analogue/digital converter used for sampling the sine (A), sine (B), cosine (A), cosine (B) signals before processing by the differential stages 18 for subsequent processing by the DSP 19 or the microcontroller to calculate the angle $\alpha$.

This solution compared with the known art which uses discrete optical encoders is also more economical and enables a higher resolution and an absolute position to be obtained. It is in fact much more complicated and decidedly more costly to construct an optical encoder and results in lower precision.

This solution (incremental encoder) also requires determination of the index position before evaluating the final position of the drive shaft, implying at least one initial rotation of the drive shaft 13 to "seek the zero".

However in certain applications, this rotation of the drive shaft 13 could result in breakage of the yarn wound on it, with consequent undesired interruption of the yarn feed process to the textile machine.

From the precise and continuous knowledge of the angular position a of the drive shaft 13, the tension, the speed and the quantity of fed yarn can be calculated and hence regulated with high precision.

A method will now be described for controlling the position of the actuator drive shaft and, on the basis thereof, controlling the yarn feed to maintain it at a characteristic required value (of yarn tension or speed or quantity), by maintaining the motor in a predefined controlled angular position or speed. This is achieved using for this angular position a measurement means fixed onto the drive shaft, and in particular an encoder, to measure the absolute angular position.

For example, with the method of the invention, the fixed angular position is maintained if the yarn is to be kept blocked in that position, so enabling the yarn tension to be brought even to very high values (without the yarn being able to drag the drive shaft into rotation), then the drive shaft is moved into a different angular position to achieve the required tension, for example the drive shaft is moved into a position preceding the last to increase tension or subsequent to the last to release it.

In particular, the method is described for controlling the feed of a yarn to a textile machine, in which the yarn unwinds from its own spool and cooperates with a rotary member associated with its own rotation actuator 2 before being directed to the textile machine. The yarn has its own characteristic value of tension and/or speed and/or quantity during this feed. In known manner, the rotation actuator 2 comprises a stator and a rotor acting on an exit drive shaft 13 which is piloted by its own piloting means 3, 6. The rotary member about which the yarn winds is keyed onto the exit drive shaft 13. According to the invention, the control method comprises:

- continuously measuring an angular position of the drive shaft of the actuator 2,
- comparing an instantaneous parameter correlated to the measured angular position of the drive shaft with a corresponding predetermined parameter relative to a predetermined characteristic value of the yarn,
- providing the piloting means 3, 6 of the actuator 2 with command signals such that said instantaneous parameter conforms to the predetermined parameter such as to obtain the desired characteristic value of the yarn fed to the textile machine.

In particular, the controlled instantaneous parameters are the angular position and/or the speed of the drive shaft 13.

Advantageously, according to the invention, this double control (position and/or speed) is suitably utilized and mixed to optimize yarn control in accordance with specific requirements of the textile machine, of the application or of the textile machine operative stage.

In other words, the precise knowledge of the angular position of the drive shaft 13, and hence of the rotor of the actuator, enables absolutely precise calculation of the command signals to be fed to the piloting means 6 at the inverter 3 which generates the rotary magnetic field moving the drive shaft 13, to hence obtain greater precision in controlling the position or speed of the actuator drive shaft and a reduction in energy wastage.

In one embodiment of the method of the invention, the initially checked instantaneous parameter is the angular position of the drive shaft 13.

The method of the invention can advantageously comprise the further steps of:

- calculating an instantaneous speed of the drive shaft 13 of the actuator 2 starting from measured angular positions of the drive shaft 13,
- comparing the instantaneous speed with a predetermined speed relative to a prefixed characteristic value of the yarn,
- providing piloting means 3, 6 for the actuator 2 with command signals such that the instantaneous speed of the drive shaft of the actuator 2 corresponds to the predetermined speed, in order to achieve the required characteristic value for the yarn fed to the textile machine.

The method of the invention can advantageously comprise the further steps of:

measuring currents flowing through the actuator piloting means, comparing instantaneous drive torque values related to the measured currents and to the measured angular position, with predetermined torques relative to a prefixed characteristic value of the yarn, providing the piloting means 3, 6 for the actuator 2 with command signals such that the instantaneous torque of the actuator drive shaft conforms to the predetermined torque, in order to achieve the required characteristic value for the yarn fed to the textile machine.

The predetermined position, speed and torque values are calculated by a main PID controller 11 which sets the predetermined parameters (set points) during the different operative steps of the textile machines.

In particular, the comparison and calculation steps are effected by PID controllers.

Moreover with the method of the invention, the precise knowledge of the motor rotor position enables torque ripple to be reduced to a minimum by again optimally calculating the three field components generated by the inverter, by the known oriented or vectorial field method. This for example enables working at constant torque, which with classical trapezoidal control is very complex and poorly efficient, particularly at low speeds. In this respect, with the method of the invention, with each absolute angular position obtained by the encoder, the system processes command signals to be fed to the piloting means 3, 6 of the actuator 2 such that the measured parameters (drive shaft position and/or speed and/or torque) conform to the predetermined parameters (set points) processed by the main PID controller 11.

In conclusion, the method of the invention, by ensuring high control precision for parameters (angular position and/or speed and possibly torque) characteristic of the actuator, enable actuator performance to be utilized to a maximum extent without energy wastage and with greater resolution than that of currently used solutions. By achieving such actuator control accuracy, a high precision can be obtained for the parameters which characterize the yarn feed.

For example, if the characteristic yarn value to be controlled is tension, then the fact of having a very accurate and continuous knowledge of the position of the drive shaft and hence of its speed and/or its angular position and possibly its torque, enables the system of the invention, by using a main PID tension controller 11, to not only feed the yarn at constant tension, but also to take it up, i.e. to rewind it with high precision and repeatability at constant tension about the rotary member or wheel of the feed device, so enabling the feed device to supply the yarn to the textile machine with very high precision, even in working processes on discontinuous textile machines or those with alternating movement.

Advantageously, with the method and system of the invention, it is therefore possible to supply a textile machine with a yarn at constant tension, speed or yarn quantity, it being possible to directly control all the physical quantities of the actuator about which the yarn to be fed to the process is wound.

With the system of the invention, it is therefore also possible during feed at constant tension or constant speed, to overfeed or take-up a precise yarn quantity based on the requirements of the textile process.

In conclusion, with the system of the invention the drive shaft speed or its position or both are controlled, together advantageously with the drive torque, such as to optimize the control of the motor itself, hence enabling a higher quality of regulation without energy losses, in contrast to conventional systems in which the motor speed is regulated in a poorly efficient and only approximate manner, in particular at low speeds, with the purpose of maintaining the yarn tension constant.

Finally, with the system and method of the invention, the yarn feed can be controlled very precisely at very low motor speed and constant high yarn tension, to obtain high drive torques at low speeds such as to hence prevent undesirable dragging of the drive shaft by the yarn at low speeds, all with high efficiency and without energy wastage.

Although the invention has been described as implemented with a textile machine, it can also be used in a machine operating on a metal wire, such as a coil winder, which unwinds from a corresponding spool and which is used to obtain transformer coils, electric motor coils or similar products. Hence, any reference to a yarn in the description has to be meant as referring to a metal wire as well.

The invention claimed is:

1. A system (1) for controlling at least the tension in a yarn or a metal wire during the feed of said yarn or said metal wire to a textile machine or coil winder or a similar machine operating on a metal wire, said yarn or wire unwinding from its own spool and cooperating with a rotary member associated with its own rotation actuator (2) before being directed to said machine, said yarn or wire having its own characteristic value of tension during this feed, said rotation actuator (2) comprising a stator and a rotor acting on an exit drive shaft (13) and being piloted by its own piloting means, said rotary member about which said yarn or wire winds being keyed onto the exit drive shaft (13), said control system comprising:

means (4) for continuously measuring an angular position of said drive shaft (13) of said actuator (2), sensor means (SE) situated downstream of said rotary member in cooperation with said drive shaft angular position measurement means (4) for generating a signal (S1) representing at least the tension in the yarn or wire during the feed based on the measurement of the angular position of the drive shaft (13);

comparison and command means (5, 8) connected downstream of said measurement means (4), to compare an instantaneous parameter corresponding to an instantaneous tension in the yarn or wire which is correlated to said measured angular position of said drive shaft (13), with a predetermined parameter relative to a prefixed characteristic value of tension of said yarn or wire, and to feed command signals to piloting means (3, 6) for said actuator (2) such that said instantaneous tension parameter conforms to said predetermined tension parameter, so as to obtain the required characteristic value of said tension of said yarn or wire being fed to said machine.

2. A system as claimed in claim 1, characterized in that said comparison and command means (5, 8) are integrated into a PID controller.

3. A system as claimed in claim 1, characterized in that said piloting means (3, 6) comprise an inverter (3) with its own control means (6).

4. A system as claimed in claim 1, characterized in that said instantaneous parameter is the angular position of said drive shaft (13).

5. A system as claimed in claim 4, characterized by comprising:

means (7) for calculating an instantaneous speed of said drive shaft (13) of said actuator (2), starting from said angular position measured by said measurement means, comparison and command means (8) connected to said speed determination means (7), which compare said measured speed with a predetermined speed relative to a prefixed characteristic value of the tension of said yarn or wire, and then feed command signals to piloting means (3, 6) of said actuator (2) such that the instantaneous speed of said drive shaft (13) conforms to said predetermined speed, so as to achieve the required characteristic value of the tension of said yarn or wire being fed to said machine.

6. A system as claimed in claim 1, characterized by comprising:

means (9) for measuring currents flowing through an inverter, comparison and command means (10) connected downstream of said current measurement means (9) to compare instantaneous drive torque values, correlated to said measured currents and to said measured angular position, with predetermined torques relative to a prefixed characteristic value of the tension of said yarn or wire, and to feed command signals to said piloting means (3, 6) for said actuator (2) so that the instantaneous torque conforms to said predetermined torque in order to achieve the required characteristic value for the tension of the yarn or wire being fed to said machine.

7. A system as claimed in claim 1, characterized in that said comparison and command means (10) are integrated into a PID controller.

8. A system as claimed in claim 1, characterized in that said predetermined reference values are obtained from a main PID controller (11).

9. A system as claimed in claim 1, characterized in that a main PID controller (11) receives said signal (S1) representative of at least the tension in said yarn or wire and compares it with reference signals (S2) for the yarn or wire characteristic value of tension.

10. A system as claimed in claim 1, characterized in that said measurement means (4) are an encoder which measures the absolute angular position of the drive shaft.

11. A system as claimed in claim 1, characterized in that said measurement means (4) comprise:

a magnetic ring (12) having at least two different magnetic portions, said ring (12) being keyed onto the drive shaft (13) of said actuator (2), a support (16) fixed relative to magnetic ring (12) and provided with at least two Hall sensors (14, 15) to measure magnetic field variations associated with the rotation of said drive shaft (13).

12. A system as claimed in claim 1, characterized in that said Hall sensors are connected to a calculation device (19) to calculate the angle associated with the signals obtained from said sensors.

13. A method for controlling at least the tension in a yarn or metal wire during the feed of said yarn to a textile machine or said metal wire to a coil winder or similar machine, said yarn or wire unwinding from its own spool and cooperating with a rotary member associated with its own rotation actuator (2) before being directed to the machine, said yarn or wire having its own characteristic value of tension during this feed, said rotation actuator (2) comprising a stator and a rotor acting on an exit drive shaft (13) and being piloted by its own piloting means, said rotary member about which said yarn or wire winds being keyed onto said exit drive shaft (13), said control method comprising the steps of:

continuously measuring an angular position of said drive shaft (13) of said actuator (2), generating a signal (S1) representing at least the tension in the yarn or wire during the feed based on the measurement of the angular position of the drive shaft (13), comparing an instantaneous parameter corresponding to an instantaneous tension in the yarn or wire which is correlated to said measured angular position of said drive shaft (13) with a corresponding predetermined parameter relative to a prefixed characteristic value of tension of said yarn or wire, providing said piloting means (3, 6) of said actuator (2) with command signals such that said instantaneous tension parameter conforms to said predetermined tension parameter so as to obtain the required characteristic value of the tension of said yarn or wire being fed to the machine.

14. A method as claimed in claim 13, characterized in that said instantaneous parameter is the angular position.

15. A method as claimed in claim 14, characterized by comprising the further steps of:

calculating an instantaneous speed of said drive shaft (13) of said actuator (2) starting from measured angular positions, comparing said instantaneous speed with a predetermined speed relative to a prefixed characteristic value of the tension of said yarn or wire, feeding command signals to piloting means (3, 6) for said actuator (2) such that the instantaneous speed conforms to said predetermined speed, in order to achieve the required characteristic value for the tension of said yarn or wire being fed to said machine.

16. A method as claimed in claim 13, characterized by comprising the further steps of measuring currents flowing through said actuator piloting means, comparing instantaneous drive torque values correlated to said measured currents and to said measured angular position with predetermined torques relative to a prefixed characteristic value of the tension of said yarn or wire, feeding command signals to piloting means (3, 6) for said actuator (2) such that said instantaneous torque conforms to said predetermined torque, in order to achieve the required characteristic value for said yarn or wire being fed to said machine.

17. A method as claimed in claim 13, characterized in that said predetermined values are calculated by a main PID controller.

18. A method as claimed in claim 13, characterized in that said steps of comparing and feeding control signals are effected by PID controllers.

* * * * *